United States Patent [19]

Delaney et al.

[11] 4,026,081

[45] May 31, 1977

[54] SUSPENDED CEILING PANEL

[75] Inventors: Leo L. Delaney, Pierrefonds; Harold Barker, Montreal, both of Canada

[73] Assignee: Aluflex Partitions (Eastern 1970) Ltd., St. Leonard, Canada

[22] Filed: May 26, 1976

[21] Appl. No.: 690,195

[52] U.S. Cl. ..... 52/222; 52/145; 52/495

[51] Int. Cl.[2] ..... E04B 1/82

[58] Field of Search ..... 52/487, 484, 475, 144, 52/145, 222, 496, 495, 497

[56] References Cited

UNITED STATES PATENTS

| | | | |
|---|---|---|---|
| 3,417,530 | 12/1968 | Long | 52/484 X |
| 3,513,613 | 5/1976 | Jones et al. | 52/222 |
| 3,841,048 | 10/1974 | Jahn | 52/484 X |

FOREIGN PATENTS OR APPLICATIONS

| | | | |
|---|---|---|---|
| 248,077 | 11/1965 | Austria | 52/496 |

*Primary Examiner*—Price C. Faw, Jr.
*Assistant Examiner*—Carl D. Friedman
*Attorney, Agent, or Firm*—Alan Swabey & Co.

[57] ABSTRACT

An acoustical insulating fiber panel having two pairs of parallel edges, elongated extruded framing members extending along the edges of the panel, each framing member being rigid and including a first web portion adapted to engage the edge of the panel, a first flange at right angles to the web for engaging the suspension hanger-flanges, a second flange extending as a projection of the lower surface of the panel and extending a short distance beyond the projection of the first flange. The second flange has further webs extending inwardly of the flange at 90° thereto and forms a material receiving jaw. An aesthetic covering material is stretched across the lower surface of the acoustical fiber panel and engages said so-formed jaws on the second flange of said framing members, and locking means are provided within the jaws for holding the edges of the covering material.

3 Claims, 3 Drawing Figures

SUSPENDED CEILING PANEL

BACKGROUND OF THE INVENTION

1. Field of the Invention

The present invention relates to a suspended ceiling system, and more particularly, to a modular panel for use in a suspended ceiling.

2. Description of the Prior Art

The art of suspended ceilings using acoustical panels is well developed. In such systems, hangers are provided which are connected to the rough, actual ceiling and which suspend support tracks in a predetermined plane at a level spaced from the actual ceiling at which it is desired to suspend the acoustical panels. The panels can be easily suspended or laid on the tracks without any specific fastening means. Lighting fixtures can also be provided in the suspended ceiling system without detracting from the functional or aesthetic appearance of the planar ceiling which is exposed. The acoustical panels in the prior art are made of a fibrous material, such as pressed paperboard, or other fibrous material which will provide a suitable exposed surface which can be painted or will otherwise have a pleasing appearance. One of the difficulties in providing suspended ceilings, of course, is that the material must be of high acoustical absorption capacity. However, it has been found that those panels having the highest acoustical characteristics provide the least pleasing exposed surface which is at least adapted to be provided with a cosmetic finish. Furthermore, the strip face of the suspended ceiling tracks detract from the aesthetic merit of the suspended ceiling since the tracks must border each panel.

There have been attempts to overcome such disadvantages, that is, to improve the acoustical characteristics of the ceiling panel without detracting from its appearance. One of the best examples of such attempts is described in U.S. Pat. No. 3,513,613, Jones et al, issued May 26, 1970. In this patent, the tracks are somewhat more sophisticated and include a pair of resilient webs or jaws which are provided on the bottom of the track. The track is somewhat cross-shaped such that it has flanges extending from its main body engaging peripheral slots provided in the acoustical panels. The jaws or webs are adapted to receive the fabric material which may be stretched on the underside of the panel between the hangers or tracks so as to camouflage the panel and to increase the variety of colours and fabric surfaces which can be used to make up the ceiling. Also, from the above-mentioned patent, the adjacent pieces of fabric abut each other, and therefore, the track is not exposed.

However, the cost of installing a suspended ceiling in accordance with the Jones et al patent is increased since the tracks must be carefully installed so that the spacing between the tracks is exact. Furthermore, tracks of the nature of the Jones et al patent must be provided in both directions, that is, at 90° to each other in order to contact each surface of the panels. Further, the fabric can only be installed or arranged on the tracks after the panel is installed, and then the edges of the fabric must be painstakingly pressed into each jaw formed by the webs of the track. Finally, as can be seen in the Jones et al patent, particularly in FIG. 1, it is more difficult to maintain the ceiling since the panels cannot be easily removed. Since the flanges of the track engage directly into peripheral slots of the panel, it can be seen that the panel cannot be easily lifted from the track and then removed and replaced.

In U.S. Pat. No. 3,417,530, Long, issued Dec. 24, 1968, there is shown a suspended ceiling system in which each acoustic panel is provided with peripheral extrusion framing having hanging flanges for engaging hangers. However, in a suspended ceiling made up of panels of the Long patent, the flanges of the extruded framing members provide an exposed strip about the periphery of the panel, thereby detracting from the aesthetic appearance of the suspended ceiling.

SUMMARY OF THE INVENTION

It is an aim of the present invention to provide an improved ceiling panel for use in a suspended ceiling which would be economical to construct and require minimum installation labour and which would be compatible to conventional hangers. It is a further aim of the present invention to provide an integral ceiling panel which is adapted to mount an exposed covering material, and when mounted, the ceiling tracks would not be exposed but the suspended ceiling would have a substantially continuous covering material surface appearance.

A construction in accordance with the present invention includes an acoustical insulating fiber panel having two pairs of parallel edges, elongated extruded framing members extending along the edges of the panel, each framing member being rigid and including a first web portion adapted to engage the edge of the panel, a first flange at right angles to the web for engaging the suspension hanger-flanges, a second flange extending as a projection of the lower surface of the panel and extending a short distance beyond the projection of the first flange, the second flange having further webs extending inwardly of the flange at 90° thereto and forming a material receiving jaw, an aesthetic covering material stretched across the lower surface of the acoustical fiber panel and engaging said so-formed jaws on the second flange of said framing members, and locking means within the jaws for holding the edges of the covering material.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
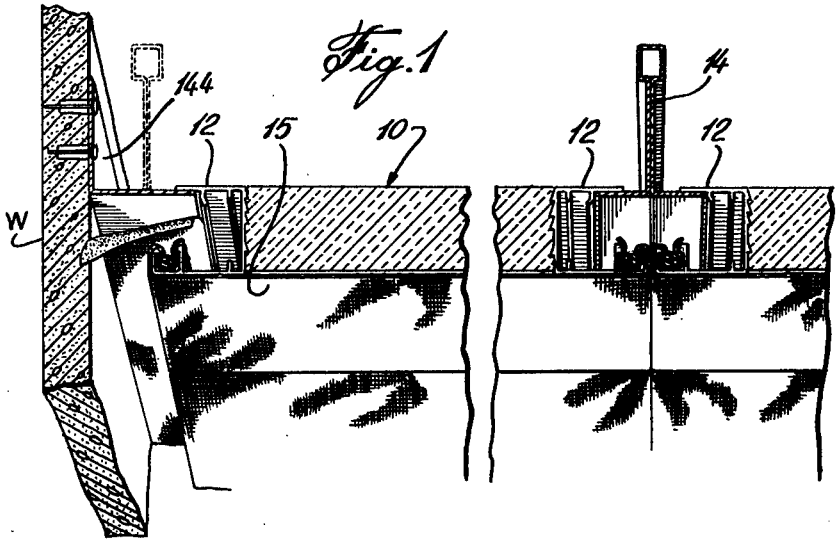
FIG. 1 is a fragmentary perspective view, partly in cross-section, showing a suspended ceiling incorporating panels in accordance with the present invention.

Referring now to the drawings, a typical panel 10 is shown having elongated extruded framing members 12 on each edge thereof, and the framing members engage T-shaped hangers 14. A fabric covering 15 of selected material and colour is stretched over the bottom surface of the panel 10 and is engaged in the framing members 12.

Figure 2:
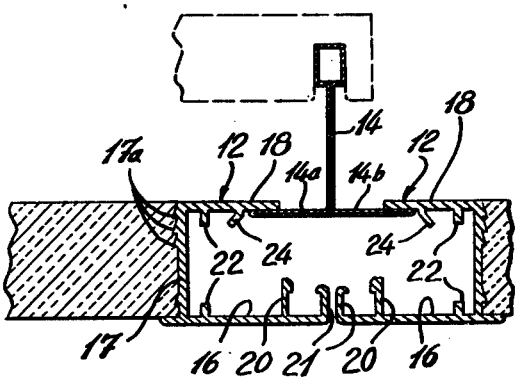
FIG. 2 is a vertical cross-section showing a detail of the assembly in FIG. 1.
Figure 3:
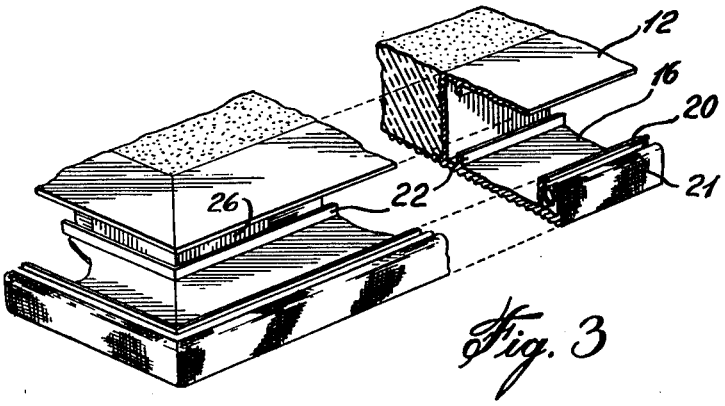
FIG. 3 is a fragmentary perspective, partly in cross-section, showing a detail of one of the panels.

The acoustical panel 10 includes a panel of approximately 1 to 2 inches in thickness made up of acoustical insulating material such as pressed glass fiber. There is no restriction from the point of view of appearance of the acoustical material since it will be covered as will be described further. There is provided about the edges of the acoustical panel, framing members 12. Each framing member includes a web 17 which engages the rough edge of the acoustical panel. Ribs 17*a* may be provided for a better grip of the panel. The web 17 is U-shaped in cross-section and includes spaced-apart parallel flanges 16 and 18 projecting from each edge of the web 17 at right angles thereto. Flange 16 extends beyond the edge of the flange 18 as shown in FIG. 2, and includes a pair of upstanding spaced-apart flanges 20 and 21. These upstanding flanges 20 and 21 form a locking slot as will be described later. Closer to the web 17 there is provided short flanges 22 defining a slot with the web 17. Finally, an angle flange 24 is provided on the flange 18 and is angled inwardly. The flanges 22 and the respective flanges 18 and 16 are provided to receive corner inserts 26 fixing adjacent framing members together at their corners. Of course, extruded member 12 is identical and can be supplied in long conventional lengths and cut to size for the particular shapes of the panel. The framing members are easily mounted about the fiber panel and held together at their corners by the inserts 26. A fabric covering material 15 stretched along the bottom of the panel 10 is engaged at its edges within the slot formed by the flanges 20 and 21. Finally, a resilient vinyl rope is inserted over the fabric within the slots so formed between the flanges 20 and 21 to lock the edge of the fabric within the slot, thus maintaining a tension on the fabric which is stretched across the bottom surface of the panel 10. In installation, each panel is hung from a typical conventional T-shaped hanger 14 having flanges 14*a* and 14*b*. The flanges 18 of adjacent panels 10 engage the flanges 14*a* and 14*b* respectively of hanger 14. The short angle flanges 24 of each extruded member act as a guide for the positioning of the panel relative to the hanger 14.

In the left-hand portion of FIG. 1, there is shown a way of hanging the panel 10 near a wall of the room in which the suspended ceiling is being hung. Either a further hanger 14 or an angle member 144 which can be nailed or otherwise fixed to the wall W and the bottom web of the angle member 144 would function as a flange of a T-shaped hanger 14. A strip of tape having an outer surface which is coordinated with the colour or fabric 15 of the panels 10 would be adhered to the bottom of the angle member 144 as shown.

We claim:

1. An acoustical ceiling panel comprising an acoustical insulating fiber panel having two pairs of parallel edges, elongated framing members extending along the edges of the panel, each framing member being rigid and including a first web portion adapted to engage the edge of the panel, a first flange at right angles to the web for engaging suspension hanger-flanges, a second flange extending as a projection of the lower surface of the panel and extending a short distance beyond the projection of the first flange, the second flange having further flanges extending at 90° thereto forming a material receiving slot, an aesthetic covering material stretched across the lower surface of the acoustical fiber panel and engaging said material receiving slot on the second flange of the framing members, and locking means within the slot for holding the edges of the covering material in the slot.

2. A panel as defined in claim 1, wherein the framing members are made of extruded metal material, such as aluminum, a pair of short flanges extending inwardly and opposed to each other from the first and second flanges spaced close to the web of the framing member, and a frame locking means adapted to be engaged between the latter flanges for fixing the adjacent framing members at each corner.

3. A panel as defined in claim 1, wherein the locking means within the slot includes a resilient elongated rope-like member forced between the flanges and the covering material to hold the edges of the covering material between the flanges.

* * * * *